US010077561B1

(12) United States Patent
Steinmetz

(10) Patent No.: US 10,077,561 B1
(45) Date of Patent: Sep. 18, 2018

(54) SIDING CORNER COVER

(71) Applicant: Scott C. Steinmetz, China, MI (US)

(72) Inventor: Scott C. Steinmetz, China, MI (US)

( * ) Notice: Subject to any disclaimer, the term of this patent is extended or adjusted under 35 U.S.C. 154(b) by 17 days.

(21) Appl. No.: 15/478,656

(22) Filed: Apr. 4, 2017

Related U.S. Application Data

(63) Continuation of application No. 29/599,402, filed on Apr. 3, 2017.

(51) Int. Cl.

| | |
|---|---|
| ***E04B 2/00*** | (2006.01) |
| ***E04F 13/073*** | (2006.01) |
| ***E04F 13/21*** | (2006.01) |
| ***E04F 19/02*** | (2006.01) |

(52) U.S. Cl.
CPC ..... *E04F 13/0733* (2013.01); *E04F 13/21* (2013.01); *E04F 19/024* (2013.01)

(58) Field of Classification Search
CPC . E04F 19/04; E04F 19/028; E04F 2019/0413; E04F 2019/0422; E04F 19/0486; E04F 19/0489; E04F 2019/0454; E04F 19/02; E04B 1/26; E04B 1/2608; E04B 7/045; E04C 3/17; Y10T 403/73
USPC ..... 297/288.1, 287.1; 52/288.1, 287.1, 712, 52/717.06; 403/403
See application file for complete search history.

(56) References Cited

U.S. PATENT DOCUMENTS

| | | | | |
|---|---|---|---|---|
| 3,304,676 | A | 2/1967 | Sallie | |
| 3,353,854 | A * | 11/1967 | Hansen | E04L 31/5818 403/171 |
| 3,651,610 | A | 3/1972 | Donahue | |
| D442,702 | S | 5/2001 | Wilson | |
| 6,553,732 | B2 | 4/2003 | Shaw | |
| D486,920 | S | 2/2004 | Hein et al. | |
| 6,751,920 | B2 * | 6/2004 | Thompson | E04B 1/26 403/403 |
| D549,841 | S | 8/2007 | Beard, Jr. | |
| D560,486 | S | 1/2008 | Ray et al. | |
| 7,591,118 | B2 * | 9/2009 | Shaw | E04D 13/15 52/287.1 |
| 7,866,102 | B2 * | 1/2011 | Meahl | E04F 19/04 52/287.1 |
| 8,141,308 | B2 | 3/2012 | Cashman | |
| 8,733,043 | B1 | 5/2014 | Cashman | |
| 9,032,676 | B2 | 5/2015 | Yarmo | |
| D775,743 | S | 1/2017 | Mort | |
| 2003/0033771 | A1 | 2/2003 | Anderson | |
| 2003/0159380 | A1 | 8/2003 | Doucet, Sr. et al. | |

(Continued)

*Primary Examiner* — Chi Q Nguyen
(74) *Attorney, Agent, or Firm* — Reising Ethington, PC

(57) ABSTRACT

The corner cover for a trim member of a building wall siding or cladding may have first and second panels each with opposed substantially planar faces inclined at an included substantially right angle to each other with a longitudinally extending vertex. Each panel may have a substantially linear bottom end extending substantially perpendicular to the longitudinal vertex. The lower portion of each panel may have a first edge portion spaced from and extending substantially parallel to the longitudinally extending vertex and an upper portion with a second outer edge portion at least in part spaced from and closer to the longitudinally extending vertex than the first edge portion and at least in part may be inclined to both the bottom and first edge portions of its associated panel.

19 Claims, 3 Drawing Sheets

(56) References Cited

U.S. PATENT DOCUMENTS

| | | | | |
|---|---|---|---|---|
| 2003/0159382 | A1* | 8/2003 | Pinto | E04F 11/1836 52/300 |
| 2004/0093823 | A1 | 5/2004 | Schiedegger et al. | |
| 2007/0151180 | A1 | 7/2007 | Pace et al. | |
| 2007/0193147 | A1* | 8/2007 | Dugger | E04F 19/028 52/287.1 |
| 2010/0151203 | A1* | 6/2010 | Good | E04F 19/028 428/156 |
| 2011/0094174 | A1* | 4/2011 | Meahl | E04F 19/04 52/288.1 |
| 2013/0263541 | A1 | 10/2013 | Ledgerwood | |
| 2015/0225966 | A1 | 8/2015 | Gazlay | |
| 2015/0259929 | A1* | 9/2015 | Koenig, Jr. | E04F 19/022 52/287.1 |

* cited by examiner

SIDING CORNER COVER

FIELD OF THE INVENTION

The present inventions relates to building wall siding and cladding and more particularly to a cover for protecting, repairing and/or improving the appearance of corner trim of building wall siding and cladding.

BACKGROUND OF THE INVENTION

The corner trim for building siding and cladding may be typically a long thin panel which typically overlies generally right angle corner walls of a building and this trim may have longitudinal edge portions which interlock with or abut adjacent siding and cladding. Alternatively, the corner trim may be a longitudinally extending post with a generally rectangular cross-section with longitudinal sides or edges which abut the adjacent siding and cladding. Both the corner trim and corner post have generally planar or flat exposed exterior faces at substantially a right angle to each other. Often, the corner trim faces and corner posts are made of aluminum, vinyl, other plastic material or wood which may become dented, fractured or otherwise damaged particularly adjacent the bottom thereof from being struck by grass trimmers, lawn mowers, snow blowers and the like or due to damage or breakage over time from inclement weather or other general wear and tear. Replacing damaged corner trim and corner posts is relatively expensive and frequently requires removal or other disengagement of adjacent siding and cladding particularly if it is interlocked with the corner trim or post. Therefore, it is desirable to cover lower damaged areas of such corner trim and posts without removing them and the need to remove any adjacent abutting or interlocking siding and cladding.

SUMMARY OF THE INVENTION

In at least some implementations, a cover may have a single body with first and second panels each with opposed substantially planar faces. The panels may be inclined at an included substantially right angle to each other with a longitudinally extending vertex. Each panel may have a substantially linear bottom edge extending substantially perpendicular to the longitudinal vertex, a lower portion with a first outer side edge spaced from and extending substantially parallel to the longitudinal vertex and an upper portion with an outer second side edge portion spaced from and closer to the longitudinal vertex than the first outer side edge portion and at least in part inclined to both the bottom and first outer side edges. The upper portion of the panels may be configured to provide the corner cover with an ascetically pleasing appearance.

BRIEF DESCRIPTION OF THE DRAWINGS

The following detailed description of preferred implementations and best mode will be set forth with regard to the accompanying drawings, in which.

DETAILED DESCRIPTION

Figure 1:
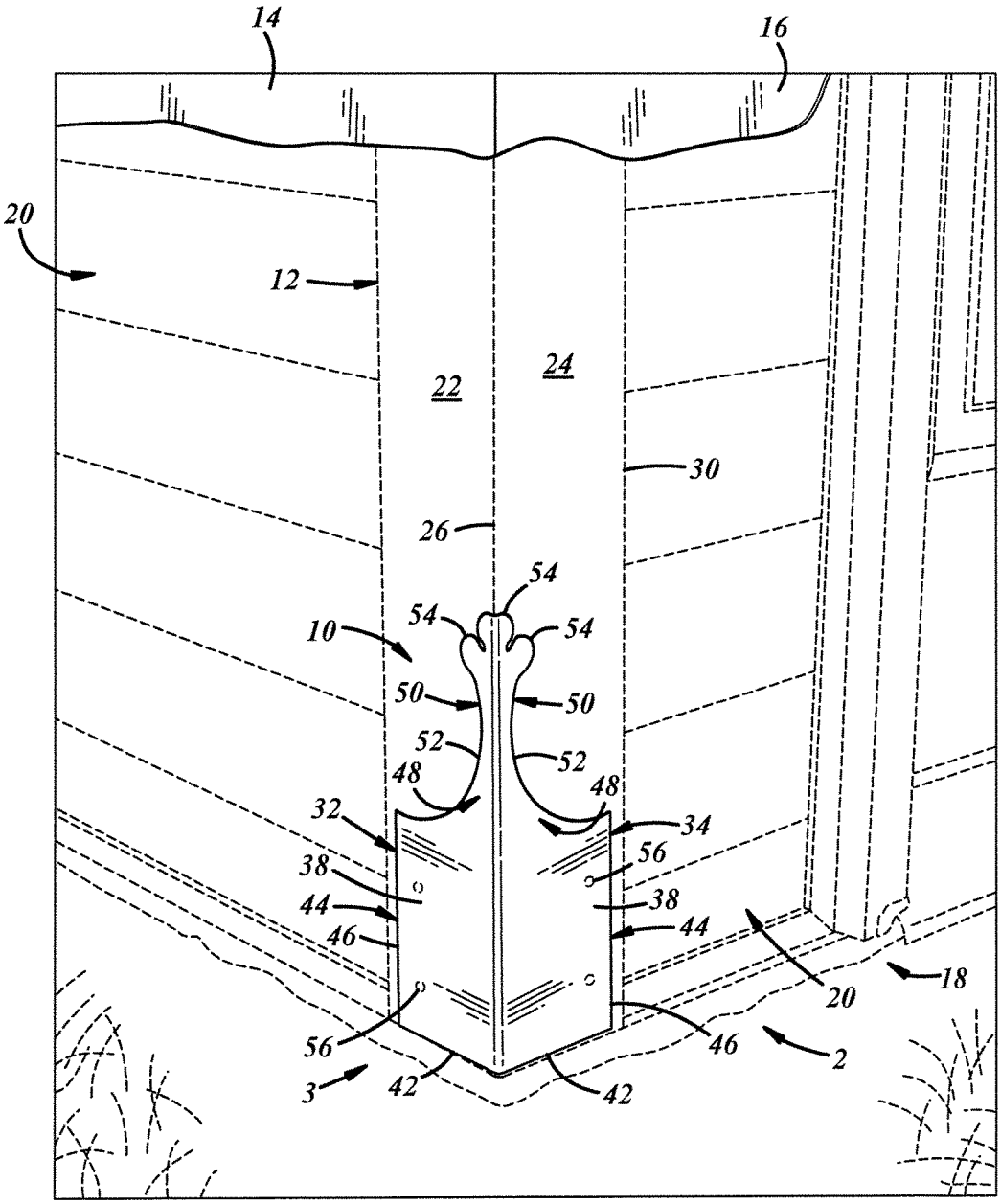
FIG. 1 is an isometric view of a siding corner cover received on the lower portion of a corner trim member of an outer corner of siding on side walls of a building.

Referring in more detail to the drawings, FIG. 1 illustrates a corner cover 10 received on and adjacent the bottom of a corner trim piece 12 received on the exterior walls 14 and 16 at right angles to each other with siding and cladding 20 on the walls. The corner trim piece 12 has planar exterior faces 20 and 22 inclined at substantially a right angle to each other with a longitudinal vertex 24 and spaced apart side edges 26, 28 extending longitudinally of the trim piece and substantially parallel to each other. The siding or cladding typically either abuts or interlocks with the surface of the edges 20 and 28 of the trim piece 12. Typically, the trim piece 12 is attached or fastened in such a way to the building walls that it cannot be removed without removing the adjacent siding and/or cladding 20 and without damaging the trim piece so that it would have to be replaced throughout its longitudinal length or height.

Figure 2:
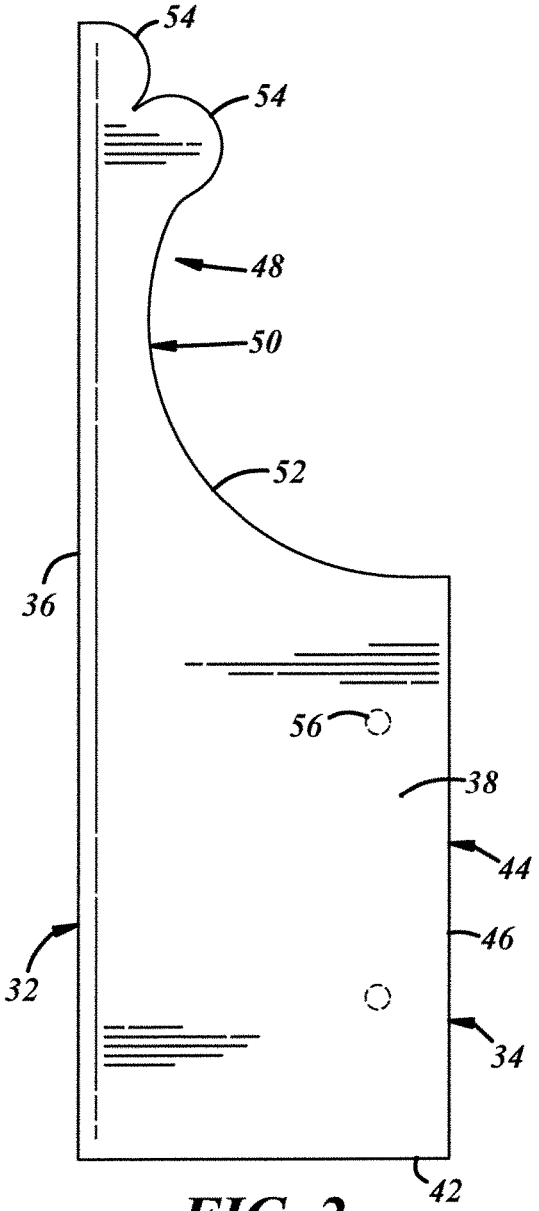
FIG. 2 is a side view in the direction of arrow 2 of the corner cover of FIG. 1 illustrating the exterior of one panel of the siding cover.
Figure 3:
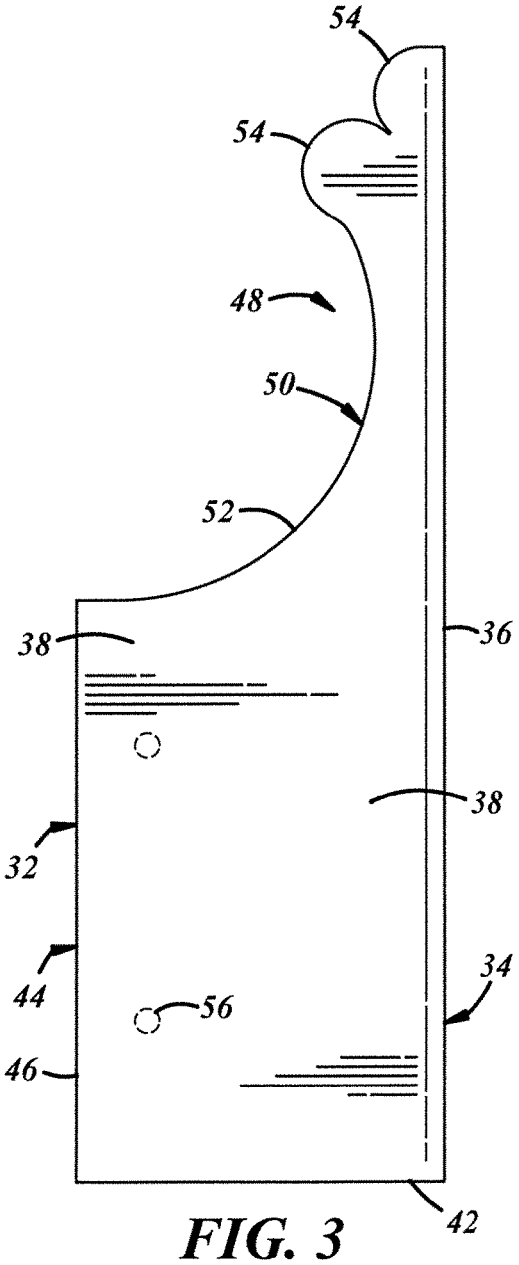
FIG. 3 is a side view in the direction of arrow 3 of the corner cover of FIG. 1 illustrating the exterior of the other panel of the siding cover.
Figure 6:
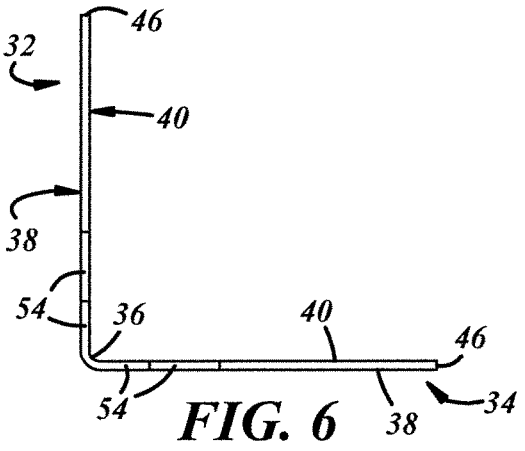
FIG. 6 is a top view of the cover of FIG. 1.
Figure 5:
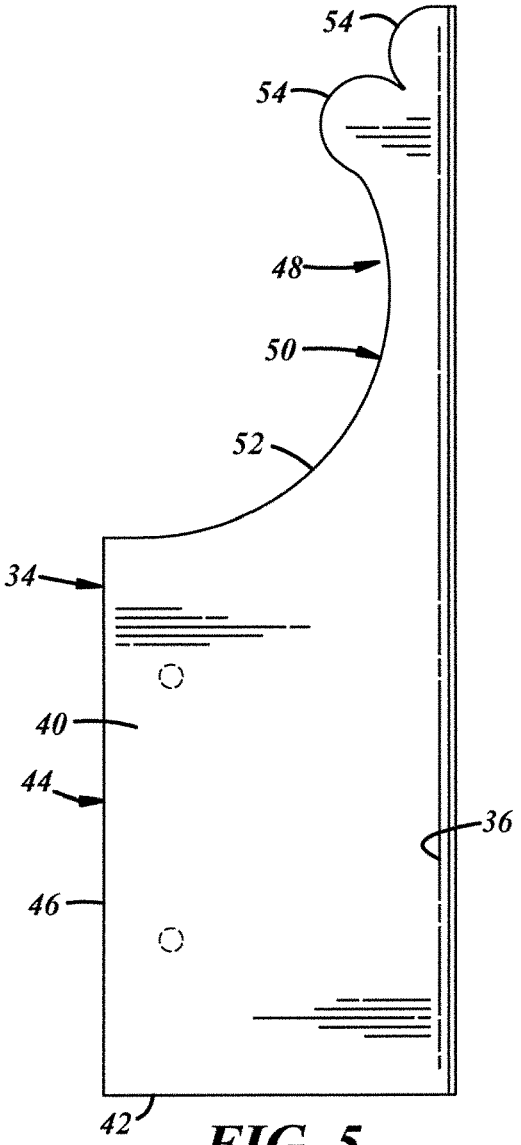
FIG. 5 is a view from the other side of the cover of FIG. 1 illustrating the back side of the one panel of FIG. 2.
Figure 4:
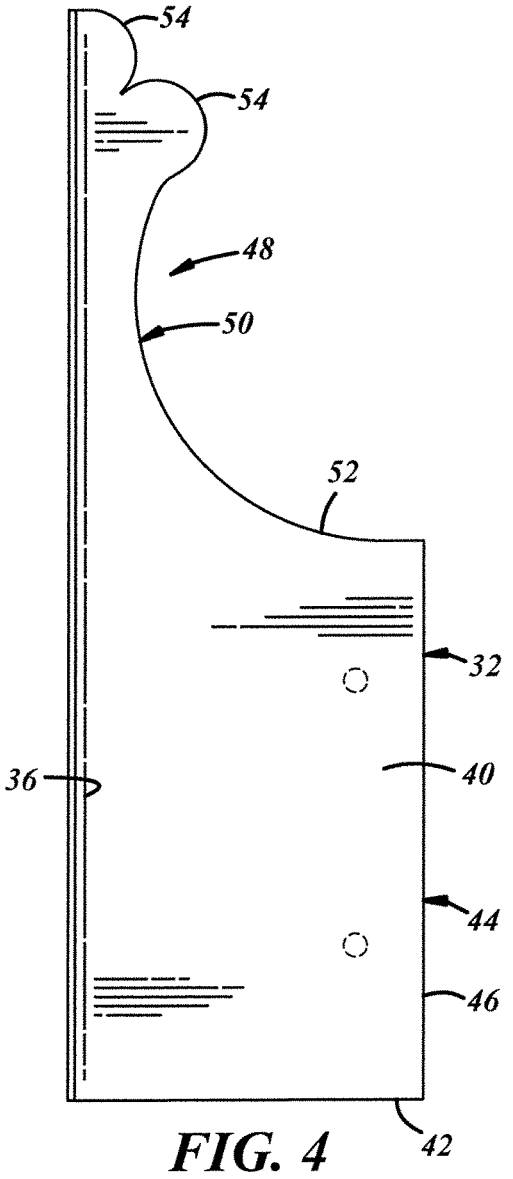
FIG. 4 is a view from the other side of the cover of FIG. 1 illustrating the back side of the other panel of FIG. 3.
Figure 7:
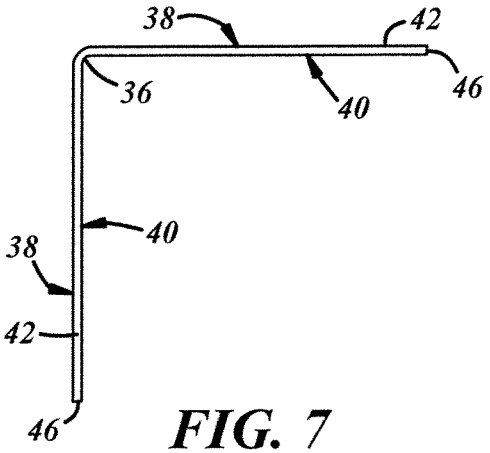
FIG. 7 is a bottom view of the cover of FIG. 1.

As shown in FIGS. 1-3, the corner cover 10 may be made of a single piece of material with two substantially planar panels 32 and 34 disposed at an included substantially right angle to each other with a longitudinally extending vertex 36. These panels may have substantially planar outer and inner opposed faces 38 and 40 and a bottom edge 42 disposed substantially perpendicular to the vertex 36. A lower portion 44 of each panel may have an outer and desirably lineal edge portion 46 extending substantially parallel to the vertex 36 and substantially perpendicular to the bottom edge 42. Desirably, the transverse width of the lower portion 44 of each panel is substantially the same as the transverse width of the corresponding face 22 or 24 of the corner trim piece 12 so that the lower portion of each panel extends to substantially the edge 28 or 30 of the trim piece 12. This will provide maximum protection of the trim piece in the event the lower portion of the corner cover 10 is struck or impacted such as by a weedwhacker, snow blower, lawn mower, etc.

Desirably, an upper portion 48 of each panel may have one or more outer edge portions 50 which are closer to the vertex 36 than the outer edge portion 46 of the lower portion of the panel. The outer edge 50 may have an arcuate portion 52 extending generally inwardly and upwardly from the upper end of the outer edge portion 46 of the lower portion and blending into pedals 54 adjacent the upper end. The pedals 54 may be arranged to collectively provide a flower-like appearance or the upper portion of a stylized flora-de-lis or pedals of a lily or other flower. The upper portion 48 may have some other configuration providing the corner cover with an ascetically pleasing appearance. The upper end of each panel may have a rounded convex portion merging into the top of the corner cover.

To facilitate attachment of a corner cover 10 to the trim piece 12, the cover may have adjacent the outer edge 46 of each panel through holes 56 through which a fastener such as a screw, rivet, nail or the like may be received. Alternatively, the corner cover 10 may be attached to the corner trim piece 12 by Velcro so that it may be removed if desired or may be permanently attached to the corner trim such as by a construction adhesive or the like.

Desirably, the length of the outer edge 46 of each panel may be at least 40% and preferably at least 50% of the overall generally vertical extent or longitudinal length of the vertex 36, while the minimum transverse extent between the outer edge 50 and the vertex 36 of the upper portion 50 of each panel is at least 15% and desirably at least 20% of the transverse width of the lower portion 44 of the panel or the transverse distance between the outer edge 46 and the vertex 36. The overall length or height of the corner cover or the longitudinal length of the vertex 36 may be greater than 10 inches and desirably greater than 12 inches. It may be about three times or four times of the transverse width of the lower portion 44 of the panel or the longitudinal length of the bottom edge 42.

The corner cover may be made in one piece of a single sheet of material such as aluminum, copper, stainless steel, galvanized steel, tin, or of any opaque plastic material such as acrylic, polycarbonate, epoxy, etc. The corner cover also may be made of a sheet of fiberglass impregnated with a suitable resin and cured, by injection molding of a suitable plastic material, or of cast metal. The material of the corner cover should have sufficient thickness and rigidity so that the corner cover is not damaged by being struck or impacted from weedwhackers, lawn mowers, snow blowers, and other lawn and garden equipment. Typically, if the corner cover is made of a sheet of copper, it will have a nominal thickness of at least about 0.028 of an inch, of aluminum at least about 0.024 of an inch, of steel at least about 0.094 of an inch, and of galvanized or tin or sheet metal at least about 0.094 of an inch.

As will be apparent to one or ordinary skill in the art, in view of the panels of the corner cover being substantially flat or planar and at substantially a right angle to each other a corner cover 12 may also be applied to and be used with and on an inside corner trim piece as well as the illustrated outside corner trim piece 12.

While the forms of this corner cover disclosed herein constitute presently preferred forms or embodiments, many others are possible as will be understood by or apparent to one of ordinary skill in the art. It is not intended herein to mention all of the possible equivalent forms or ramifications of this corner cover invention. It is understood that the terms used herein are merely descriptive, rather than limiting, and that various changes may be made without departing from the spirit or scope of this corner cover invention.

The invention claimed is:

1. A corner cover for a building wall siding or cladding trim member having substantially planar exposed exterior faces at substantially a right angle to each other, comprising:

a single body having protective first and second panels each with opposed substantially planar faces each of the first and second panels is configured to overlay part of an exposed exterior face of the wall siding or cladding trim;

the first and second panels inclined at an included substantially right angle to each other with a longitudinally extending vertex and each panel having a substantially linear bottom edge extending substantially perpendicular to the longitudinally extending vertex;

a lower portion of each panel extending to and having an outer first edge linear portion laterally spaced from and extending substantially parallel to the longitudinally extending vertex and the first edge linear portion has a length of at least 40% of the longitudinally extending vertex; and an upper portion of each panel extending to and having an outer second edge portion with at least part thereof spaced from and closer to the longitudinally extending vertex than the first edge linear portion, disposed longitudinally above the bottom and first edge portions thereof and at least in part inclined to both the bottom and first edge portions thereof.

2. The corner cover of claim 1 wherein the body and panels are of a single piece of material.

3. The corner cover of claim 1 wherein the panels are of metal.

4. The corner cover of claim 1 wherein the panels are made of one of copper, aluminum, steel, stainless steel, galvanized steel, tin, or a plastic material.

5. The corner cover of claim 1 wherein the panels are made of an acrylic, epoxy, or polycarbonate material.

6. The corner cover of claim 1 wherein the outer first edge of each panel is configured so that in assembly such first edge is proximate to an outer edge of an exterior face of a trim member which such panel overlies.

7. The corner cover of claim 1 wherein the outer first edge of the lower portion of each panel is laterally spaced from the longitudinally extending vertex in the range of 3 inches to 6 inches.

8. The corner cover of claim 1 wherein the outer first edge of the lower portion of each panel is laterally spaced from the longitudinally extending vertex in the range of 3 inches to 4 inches.

9. The corner cover of claim 1 wherein the outer first edge of the lower portion of each panel is laterally spaced substantially 3½ inches from the longitudinally extending vertex.

10. The corner cover of claim 1 wherein the outer first edge of the lower portion of each panel is laterally spaced substantially 4 inches from the longitudinally extending vertex.

11. The corner cover of claim 1 wherein the length of the longitudinally extending vertex is at least 10 inches.

12. The corner cover of claim 1 wherein the length of the longitudinally extending vertex is in the range of 10 inches to 15 inches.

13. The corner cover of claim 1 wherein the outer first edge of the lower portion of each panel has a length which is at least 50% of the length of the longitudinally extending vertex.

14. The corner cover of claim 1 wherein the outer second edge of the upper portion of each panel has a generally longitudinal extent and more than half thereof is laterally spaced from the longitudinally extending vertex by at least 15% of the length of the bottom edge of such panel.

15. The corner cover of claim 1 wherein the outer second edge of the upper portion of each panel has a generally longitudinal extent and more than half thereof is laterally spaced from the longitudinally extending vertex by at least 20% of the length of the bottom edge of such panel.

16. The corner cover of claim 1 wherein the outer second edge of the upper portion of each panel is at least in part concave and the concave part extends generally longitudinally along at least half of the outer second edge of such upper portion of its associated panel.

17. The corner cover of claim 1 wherein the outer second edge of the upper portion of each panel includes at least one convex portion.

18. The corner post of claim 1 wherein the outer second edge of the upper portion of each panel has a rounded convex portion merging into the top of the corner cover.

19. A corner cover assembly comprising:

a building wall with a siding or cladding trim member having substantially planar exposed exterior faces at substantially a right angle to each other, a cover with a single body having first and second panels each with opposed substantially planar faces, and overlying a portion of the planar exposed exterior faces of the wall siding or cladding trim member;

the first and second panels inclined at an included substantially right angle to each other with a longitudinally extending vertex of at least 10 inches and each panel having a substantially linear bottom edge extending in the range of 3 to 6 inches substantially perpendicular to the longitudinally extending vertex;

a lower portion of each panel having an outer first edge linear portion laterally spaced in the range of 3 to 6 inches from and extending substantially parallel to the longitudinally extending vertex;

the first edge linear portion of each panel extending generally longitudinally at least 40% of the length of the longitudinally extending vertex; and an upper portion of each panel having an outer second edge portion with at least part thereof spaced from and closer to the longitudinally extending vertex than the first edge portion, disposed longitudinally above the bottom and first edge portions thereof, at least in part inclined to both the bottom and first edge portions thereof, and laterally spaced from the longitudinally extending vertex by at least 15% of the length of the bottom edge portion of the lower portion of such panel.

* * * * *